US007242874B2

(12) United States Patent
Tsusaka

(10) Patent No.: US 7,242,874 B2
(45) Date of Patent: Jul. 10, 2007

(54) IMAGE FORMING APPARATUS AND CARTRIDGE WITH A RECORDING MEDIUM AND CARTRIDGE DETECTING DEVICE

(75) Inventor: Shusaku Tsusaka, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 179 days.

(21) Appl. No.: 11/089,316

(22) Filed: Mar. 25, 2005

(65) Prior Publication Data

US 2005/0220461 A1 Oct. 6, 2005

(30) Foreign Application Priority Data

Mar. 31, 2004 (JP) ..... 2004-105505

(51) Int. Cl.
*G03G 15/00* (2006.01)
*G03G 21/16* (2006.01)
*G03G 21/18* (2006.01)

(52) U.S. Cl. ..... 399/13; 399/111; 399/113; 399/119

(58) Field of Classification Search ..... 399/12, 399/13, 25, 111, 119, 120, 262
See application file for complete search history.

(56) References Cited

U.S. PATENT DOCUMENTS 6,101,350 A 8/2000 Suzuki et al.
6,885,831 B2 * 4/2005 Lee ..... 399/13

FOREIGN PATENT DOCUMENTS

| | | |
|---|---|---|
| JP | A 6-208263 | 7/1994 |
| JP | A 7-301992 | 11/1995 |
| JP | A 8-160835 | 6/1996 |
| JP | A 9-292816 | 11/1997 |
| JP | A 10-161414 | 6/1998 |
| JP | A 11-133839 | 5/1999 |
| JP | A 2000-89644 | 3/2000 |
| JP | A 2000-98680 | 4/2000 |
| JP | A 2001-34100 | 2/2001 |

* cited by examiner

*Primary Examiner*—Hoang Ngo
(74) *Attorney, Agent, or Firm*—Oliff & Berridge, PLC

(57) ABSTRACT

An image forming apparatus includes a recording medium accommodating portion that is capable of accommodating a recording medium; a feed path along which the recording medium is capable of being fed from the recording medium accommodating portion; and a detector, disposed on the feed path, capable of detecting (1) a cartridge that is capable of being installed in the image forming apparatus when the cartridge is installed in the image forming apparatus and (2) the recording medium when the recording medium passes through the feed path when the cartridge is installed in the image forming apparatus.

22 Claims, 11 Drawing Sheets

IMAGE FORMING APPARATUS AND CARTRIDGE WITH A RECORDING MEDIUM AND CARTRIDGE DETECTING DEVICE

CROSS-REFERENCE TO RELATED APPLICATION

This application claims priority from Japanese Patent Application No. 2004-105505, filed Mar. 31, 2004. The entire subject matter of which is incorporated herein by reference hereto.

BACKGROUND

The disclosure relates to an image forming apparatus and a cartridge that is capable of being used with an image forming apparatus.

There exists image forming apparatuses that form an image by developing an electrostatic latent image on a photosensitive member. For example, Japanese Laid-Open Patent Publication No. 6-208263 discloses an image forming apparatus with a pick-up roller that feeds a sheet to a sheet feed path from a sheet accommodating portion disposed on a lower part of the image forming apparatus. An image is formed on the sheet while the sheet is being fed in the sheet feed path. After image formation, the sheet is discharged onto a discharge tray provided on an upper part of the image forming apparatus.

The image forming apparatus is provided with a cartridge that includes a toner tank. The cartridge is capable of being removed from the image forming apparatus, for example, when an amount of toner remaining in the toner tank becomes small. Toner can thus be replenished by replacing the cartridge.

The image forming apparatus is also provided with a sensor that detects the cartridge. The sensor prevents the image forming operations from operating when the cartridge is not installed in the image forming apparatus. Another sensor that detects whether the sheet has passed is disposed on the sheet feed path. The sensor is used to confirm that a sheet jam (i.e., a paper jam) has not occurred by detecting the sheet at an appropriate timing.

SUMMARY

In the image forming apparatus, the sensor that detects the cartridge, which is removable from the image forming apparatus, and the sensor that detects the passage of the sheet on the sheet feed path are separately provided. Thus, the number of the sensors employed is increased, leading to an increase in production costs.

The image forming apparatus must also include additional space in order to mount the sensors, thus leading to an increase in the size of the image forming apparatus. After the cartridge is installed in the image forming apparatus, a detecting condition of the sensor that detects the cartridge does not change until the cartridge is replaced. Therefore, the sensor that detects the cartridge may not be effectively used.

The disclosure thus provides, among other things, a downsized image forming apparatus in which a sensor that detects a cartridge, which is removable from the image forming apparatus, is effectively used.

In exemplary embodiments, an image forming apparatus may include a recording medium accommodating portion that is capable of accommodating a recording medium; a feed path along which the recording medium is capable of being fed from the recording medium accommodating portion; and a detector, disposed on the feed path, capable of detecting (1) a cartridge that is capable of being installed in the image forming apparatus when the cartridge is installed in the image forming apparatus and (2) the recording medium when the recording medium passes through the feed path when the cartridge is installed in the image forming apparatus.

In exemplary embodiments, a cartridge may include a developer accommodating portion that is capable of accommodating a developer; and a first movement member, located outside the developer accommodating portion, that is capable of moving to a first position when the cartridge is mounted in an image forming apparatus and is capable of moving to a second position that is different from the first position when the cartridge is mounted in the image forming apparatus and a recording medium contacts the first movement member.

BRIEF DESCRIPTION OF THE DRAWINGS

Exemplary embodiments of the disclosure will be described in detail with reference to the following figures wherein.

DETAILED DESCRIPTION OF EMBODIMENTS

Figure 1:
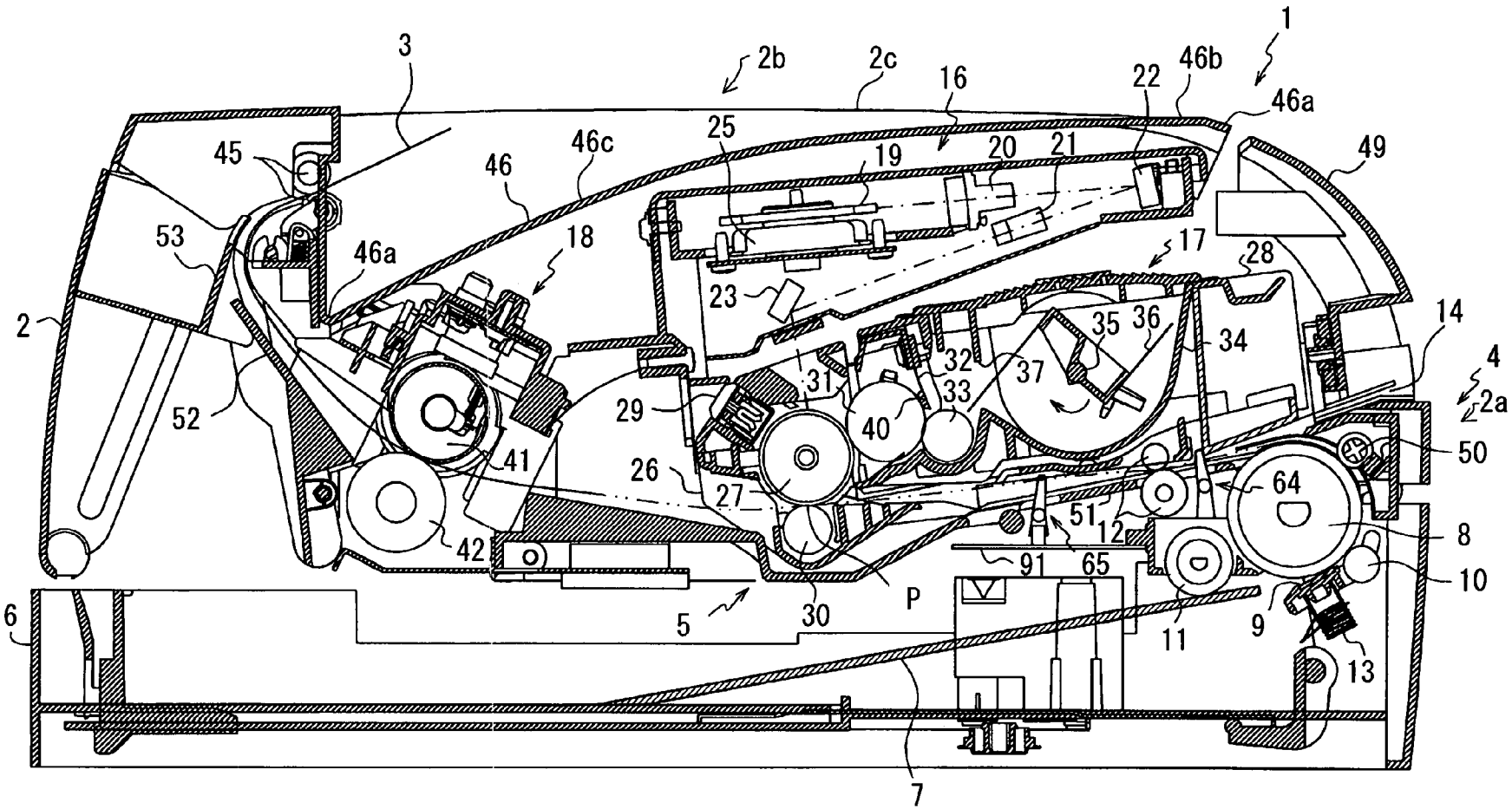
FIG. 1 is a side cross sectional view of a printer as an example of an image forming apparatus according to a first embodiment of the disclosure.

Exemplary embodiments of the disclosure will be described with reference to the accompanying drawings. FIG. 1 shows a side cross sectional view of a printer 1 viewed from an axial direction of rollers of the printer 1. The right side in FIG. 1 is defined as a front side and the left side is defined as a rear side. A front cover 49 is disposed on a front side face (front face) 2*a* of the printer 1.

As shown in FIG. 1, the printer 1 is provided in a main casing 2 with a feeder portion 4 for feeding a paper sheet 3 (recording medium) and an image forming portion 5 for forming an image on the fed sheet 3. Disposed in an upper portion of the printer 1 is a discharge tray 46 that is used to hold the discharged sheet 3 having an image formed thereon by the printer 1.

The feeder portion 4 has a sheet cassette 6, a sheet mount plate 7 arranged within the sheet cassette 6, a sending-out roller 11 arranged above one end portion of the sheet cassette 6, a pick-up roller 8, a separation pad 9, a pinch roller 10 opposing the pick-up roller 8, a sheet powder removing roller 50, and register rollers 12 arranged downstream of the sheet powder removing roller 50 in a sheet feeding direction.

The sheet cassette 6 is removably set on a bottom of the main casing 2 and is used to accommodate a stack of the sheets 3 in the sheet cassette 6. The sheet cassette 6 is pulled out toward the front side of the printer 1 (right side in FIG. 1) when the sheets 3 are added to the sheet cassette 6. When the sheet cassette 6 is pulled from the main casing 2, the pick-up roller 8 and the separation pad 9 separate so that the pinch roller 10, the separation pad 9 and a spring 13 arranged on a back side of the separation pad 9 are pulled out together with the sheet cassette 6.

The sheet mount plate 7 is pivotally supported on an end far from the pick-up roller 8, so that the other end of the sheet mount plate 7, near the pick-up roller 8, can be moved in a vertical direction. The sheet mount plate 7 is urged upwardly by a spring (not shown). As the amount of the sheets 3 stacked on the sheet mount plate 7 increases, the sheet mount plate 7 pivots downward about the one end far from the pick-up roller 8 against an urging force of the spring.

The sending-out roller 11 is disposed so as to contact the uppermost sheet 3 stacked on the sheet mount plate 7 in the sheet cassette 6. The sending-out roller 11 feeds the sheet 3 to a position where the pick-up roller 8 can feed the sheet 3, that is, to a position between the pick-up roller 8 and the separation pad 9.

The separation pad 9 is arranged in confrontation with the pick-up roller 8. The separation pad 9 is pressed toward the pick-up roller 8 by the spring 13 arranged on the back side of the separation pad 9. The separation pad 9 has a function for preventing plural sheets 3 from being supplied in an overlapping state into a sheet feed path (shown by the two-dotted chain line in FIG. 1). More specifically, the sheet 3 sent by the sending-out roller 11 comes into contact with the pick-up roller 8 and the separation pad 9. At this time, some frictional force is applied between the separation pad 9 and the sheet 3. Accordingly, even when the plural sheets 3 are sent by the sending-out roller 11 to the separation pad 9, the sheets 3 other than the uppermost sheet 3 are stopped by the separation pad 9. Therefore, the sheet 3 is supplied one at a time from the pick-up roller 8.

The sheet 3 fed by the pick-up roller 8 is sent to the sheet feed path. At this time, sheet powder or fibers are removed from the sheet 3 by the sheet powder removing roller 50. Then, the sheet 3 is fed to the register rollers 12. The sheet feed path slopes downward with respect to the horizontal direction from the upper end of the pick-up roller 8 to an image forming position P. A substantial part of the sheet feed path between the pick-up roller 8 and the image forming position P is formed by a guide member 51 provided on the main casing 2 and by a bottom of a process cartridge 17 when the process cartridge 17 is mounted in the main casing 2.

The pick-up roller 8 sends the sheet 3 to the register rollers 12 by turning the sheet 3 about 180 degrees. When a curvature of the path used for curving or turning the sheet 3 around the pick-up roller 8 is large and the sheet 3 is of a thick material, such as a postcard, the sheet 3 may possibly be bent or may not be conveyed to the register rollers 12 due to the resistance applied by the sheet 3 when the sheet 3 is bent.

Accordingly, the diameter of the pick-up roller 8 is set larger than other rollers in the printer 1, such as a photosensitive drum 27 and a heat roller 41. More specifically, the diameter of the pick-up roller 8 is set to about 33 mm in the embodiment when the diameter of the photosensitive drum 27 is set to about 24 mm and the diameter of the heat roller 41 is set to about 25 mm. As the diameter of the pick-up roller 8 is set relatively large and the curvature of the path used for curving the sheet 3 around the pick-up roller is thus set small, the sheet 3 can be preferably conveyed by the pick-up roller 8 without bending the sheet 3.

The register rollers 12 are made up of a pair of rollers. Driving and stopping the register rollers 12 are controlled by a controller 70 (in FIG. 6), based on the detection timing of the sheet 3 by a detector 64 disposed near the register rollers 12. A detector 65 is disposed between the register rollers 12 and the image forming position P on the sheet feed path. The detector 65 also detects the sheet 3, similar to the detector 64. The detectors 64, 65 are of a mechanical type. As a lever 66 of the detector 64, 65 contacts the sheet 3, the lever 66 is pushed and moved relative to the sheet feeding direction. The detectors 64, 65 will be described in detail below.

A manual feed slot 14 for directly feeding the sheet 3 from the front side of the printer 1 to the register rollers 12 is formed above the pick-up roller 8. The sheet 3 can be supplied to the sheet feed path without storing the sheet 3 in the sheet cassette 6.

The image forming portion 5 includes a scanner unit 16, the process cartridge 17, and a fixing unit 18. The scanner unit 16 is arranged in an upper portion of the main casing 2. The scanner unit 16 has a laser light emitting portion (not shown), a polygon mirror 19 driven by a polygon motor 25 so as to rotate, lenses 20, 21, and reflecting mirrors 22, 23. As shown by the one-dotted chain line in FIG. 1, a laser beam emitted from the laser emitting portion based on image data, passes through or reflects off the polygon mirror 19, the lens 20, the reflecting mirror 22, the lens 21 and the reflecting mirror 23 in this order to irradiate a surface of the photosensitive drum 27 of the process cartridge 17 with the laser beam at a high speed.

More specifically, the polygon mirror 19 is arranged over the photosensitive drum 27 and the image forming position P. In the scanner unit 16, the laser beam reflected off the polygon mirror 19 is advanced toward the reflecting mirror 22 substantially in the horizontal direction. Then, the laser beam is reflected off the reflecting mirror 22 toward the reflecting mirror 23 located below the polygon mirror 19. More specifically, the reflecting mirror 22 reflects the incident laser beam at an acute angle, so as to direct the incident laser beam downward by about 15 degrees, with respect to the horizontal direction. The scanner unit 16 including the polygon mirror 19, the lenses 20, 21, and the reflecting mirrors 22, 23 is set to such a size and shape that do not interfere with the optical path of the laser beam. The scanner unit 16 is formed into a taper shape, such that the image forming position P side to which the polygon mirror 19 is located is thick and the pick-up roller 8 side is thin.

The process cartridge 17 is arranged below the scanner unit 16. When the process cartridge 17 is mounted in an installation portion **2*d* of the main casing 2, the process cartridge 17 is moved substantially in the horizontal direction and in the forward and backward directions (left and right directions in FIG. 1: attaching and detaching directions). The installation portion 2*d* is an example of a cartridge installation portion. The process cartridge 17 includes a drum cartridge 26 and a developing cartridge 28. A space is defined between the process cartridge 17 and the scanner unit 16, when the process cartridge 17 is installed in the main casing 2**.

Figure 4A:
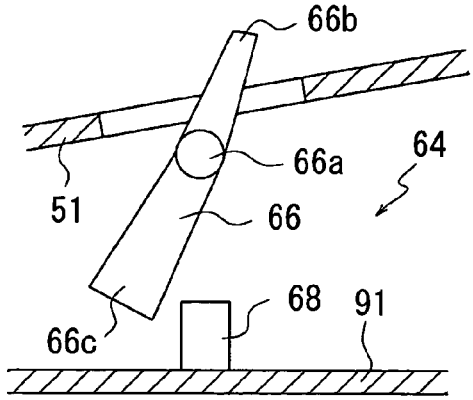
FIGS. 4A-4D are explanatory views illustrating operations of a detector.
Figure 4B:
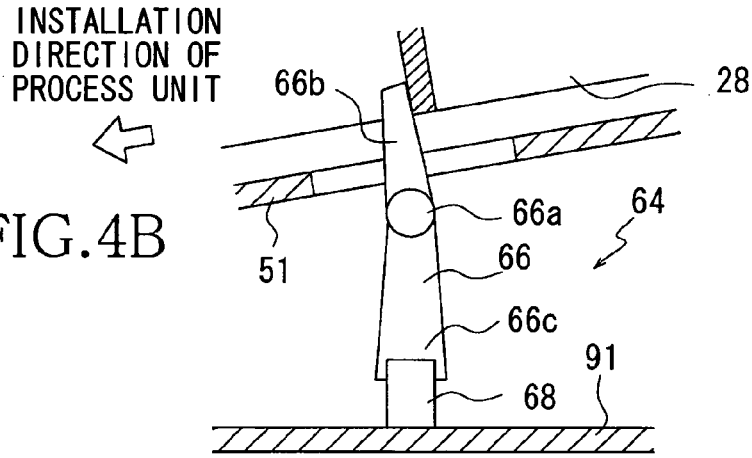

When the process cartridge 17 is mounted in the printer 1, the lever 66 of the detector 64, as show in FIG. 4B, contacts the developing cartridge 28 of the process cartridge 17, and moves to a predetermined position.

The drum cartridge 26 of the process cartridge 17 includes the photosensitive drum 27, a scorotron charger 29 and a transfer roller 30. The developing cartridge 28 includes a developing roller 31, a layer thickness regulating plate 32, a toner supply roller 33, and a toner box 34. The developing cartridge 28 is detachably set in the drum cartridge 26.

The photosensitive drum 27 and the toner box 34 require a large amount of space relative to other components of the process cartridge 17. Therefore, the photosensitive drum 27 and the toner box 34 are not disposed directly above the pick-up roller 8 and the register rollers 12 that require a comparatively large amount of space in the vicinity of the process cartridge 17.

The toner box 34 is filled with toner (developing agent). The toner within the toner box 34 is agitated by rotating an agitator 36, which is supported by a rotating shaft 35 arranged at a substantially central portion of the toner box 34, in the clockwise direction, as indicated by the arrow in FIG. 1. The agitated toner is discharged from a toner supply port 37 formed in the toner box 34.

The toner supply roller 33 is arranged to the side of the toner supply port 37, so as to rotate in the counterclockwise direction. The developing roller 31 is disposed in confrontation with the toner supply roller 33, so as to rotate in the counterclockwise direction. The toner supply roller 33 and the developing roller 31 contact each other so as to apply some pressure to each other.

The toner supply roller 33 includes a metal roller shaft covered by a roller portion formed of conductive foam. The developing roller 31 includes a metal roller shaft covered by a roller portion formed of a conductive rubber material having no magnetic characteristics. More specifically, the roller portion of the developing roller 31 is formed of conductive urethane rubber or silicone rubber including fine carbon particles. A surface of the roller portion of the developing roller 31 is coated with urethane rubber or silicone rubber including fluorine. A developing bias is applied to the developing roller 31.

The layer thickness regulating blade 32 is arranged in the vicinity of the developing roller 31. The layer thickness regulating blade 32 includes a blade body formed of a metal plate spring and a pressing portion 40 disposed at an end of the blade body and formed of insulating silicone rubber into a substantially semicircular shape in cross section. The layer thickness regulating blade 32 is supported by the developing cartridge 28 near the developing roller 31. The pressing portion 40 presses the surface of the developing roller 31 with the elasticity of the blade body.

The toner discharged from the toner supply port 37 is supplied to the developing roller 31 by the rotation of the toner supply roller 33. At this time, the toner is positively frictionally charged between the toner supply roller 33 and the developing roller 31. The toner supplied onto the developing roller 31 enters between the pressing portion 40 of the layer thickness regulating blade 32 and the developing roller 31, as the developing roller 31 is rotated. The toner is further sufficiently frictionally charged and is carried onto the developing roller 31 as a thin layer having a constant thickness.

The photosensitive drum 27 is arranged to the side of the developing roller 31 in confrontation with the developing roller 31, so as to rotate in the clockwise direction. A drum body of the photosensitive drum 27 is grounded and its surface is formed of a positively chargeable photosensitive layer including polycarbonate. The photosensitive drum 27 is rotated by a drive force from a main motor (not shown).

The scorotron charger 29 is disposed with a predetermined distance between the scorotron charger 29 and the photosensitive drum 27, to prevent the charger 29 from contacting the photosensitive drum 27. The scorotron charger 29 is arranged about 30 degrees in an upward radial direction of the photosensitive drum 27, with respect to the horizontal direction. The charger 29 is a positively charging scorotron charger that generates corona discharge from a tungsten wire. The scorotron charger 29 uniformly and positively charges the surface of the photosensitive drum 27.

The surface of the photosensitive drum 27 is first charged uniformly and positively by the scorotron charger 29 while the photosensitive drum 27 is rotated. Thereafter, the surface of the photosensitive drum 27 is selectively exposed to the laser beam emitted from the scanner unit 16 to scan across the surface of the drum 27 at a high speed. Thus, an electrostatic latent image, based on predetermined image data, is formed on the surface of the photosensitive drum 27.

Thereafter, as the toner, which is carried on the developing roller 31 and is positively charged, is brought into confrontation with the photosensitive drum 27 in accordance with the rotation of the developing roller 31, the toner is supplied to the electrostatic latent image on the surface of the photosensitive drum 27. That is, parts of the photosensitive drum 27 selectively exposed to the laser beam where the potential level is lower than the remaining part of the photosensitive drum 27 surface that is uniformly and positively charged. Thus, the electrostatic latent image on the photosensitive drum 27 is made visible to complete a reverse image developing.

The transfer roller 30 is arranged below the photosensitive drum 27 so as to face the photosensitive drum 27. The transfer roller 30 is rotatably supported by the drum cartridge 26 in the counterclockwise direction. The transfer roller 30 includes a metal roller shaft covered by a roller portion formed of an ionic conductive rubber material. A transfer bias (transfer forward bias) is applied to the transfer roller 30 during transfer of the toner onto the sheet 3. The visible toner image carried onto the surface of the photosensitive drum 27 is transferred onto the sheet 3 while the sheet 3 passes the image forming position P between the photosensitive drum 27 and the transfer roller 30.

The fixing unit 18 is arranged downstream of the process cartridge 17 in the sheet feeding direction behind the process cartridge 17. The fixing unit 18 includes the heat roller 41 formed with a gear, and a pressing roller 42 that presses the heat roller 41.

The heat roller 41 is formed of metal and is provided with a halogen lamp as a heat source. In the fixing unit 18, the heat roller 41 fixes the toner transferred onto the sheet 3 in the process cartridge 17, while the sheet 3 passes between the heat roller 41 and the pressing roller 42, by the applications of heat and pressures. Further, the heat roller 41 feeds the sheet 3 having an image fixed thereon to discharge rollers 45, through a discharge path formed by guide members 52, 53. The discharge rollers 45 discharge the sheet 3 onto the discharge tray 46. A pair of discharge rollers 45 is disposed near a discharge port for discharging the sheet 3 out of the printer 1.

If the sheet 3, subjected to heat application by the heat roller 41, is suddenly or steeply curved, the curved sheet 3 may not return to the original state. Therefore, the guide members 52, 53 to which the sheet 3 contacts after passing the heat roller 41, are formed such that the sheet 3 is gently curved in a heat applied condition soon after passing the heat roller 41 and is more greatly curved as the sheet 3 approaches the discharge rollers 45.

The discharge tray 46 has a gradually downward slope from the front side of the printer 1 to the rear side (left side in FIG. 1). A deepest portion 46*a* of the discharge tray 46 is set lower than the upper end of the fixing unit 18 or the polygon mirror 19. Therefore, the discharge rollers 45 can be disposed at relatively lower positions without reducing the number of the sheets 3 stackable in the discharge tray 46. Thus, the height of the printer 1 at a position where the scanner unit 16 is disposed and the height of the printer 1 at a position where the discharge rollers 45 are disposed, can be brought closer to each other. Therefore, the printer 1 can have a good design and appearance.

More specifically, a top cover 2*c* having the discharge tray 46 is arranged on a top face 2*b* of the printer 1. The discharge tray 46 has a curved portion 46*c* curved upward toward the front side, a flat portion 46*b* connected to a front end portion of the curved portion 46*c*, and a round portion 46*a* connected to a front end portion of the flat portion 46*b*.

Figure 2:
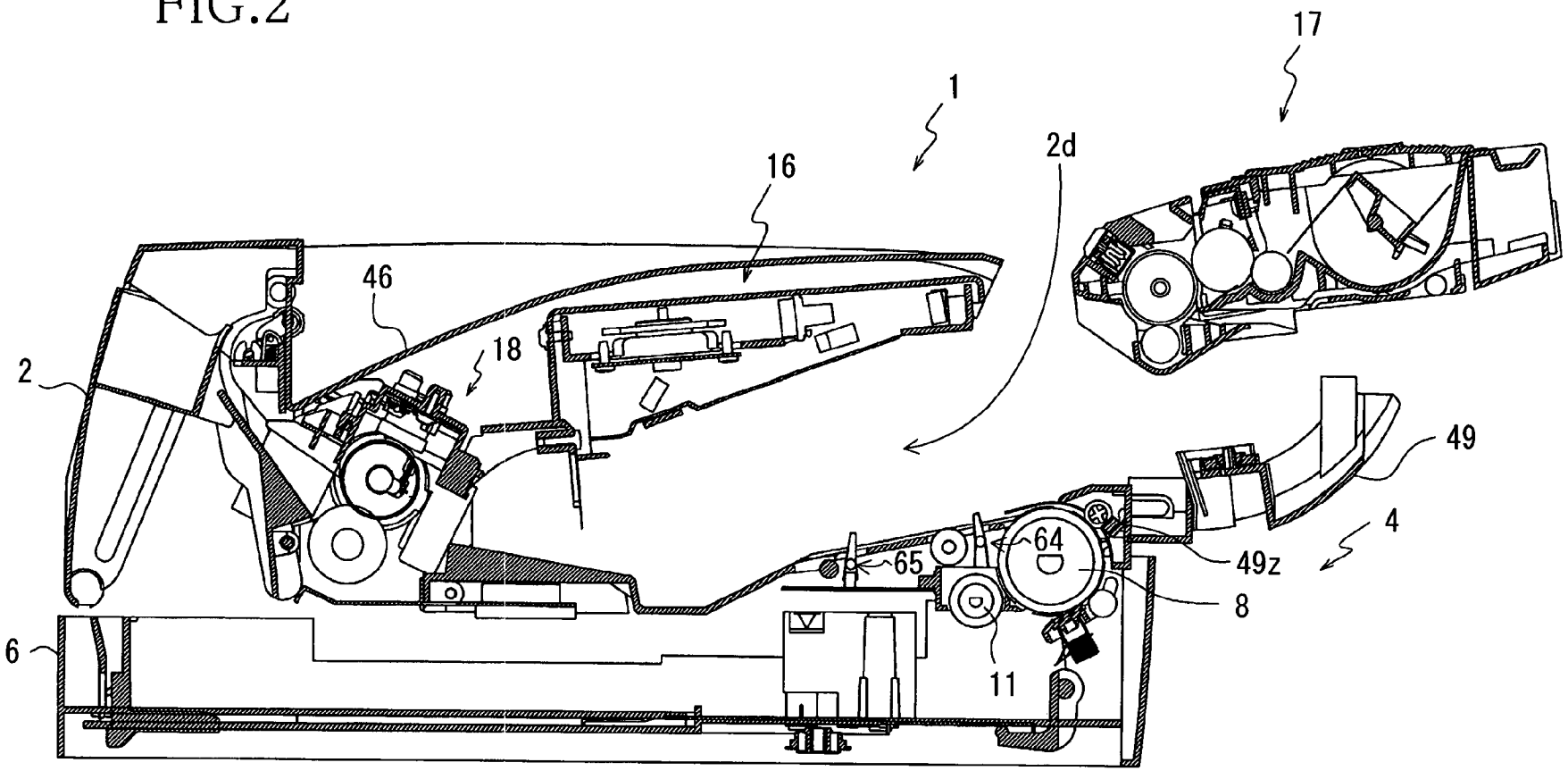
FIG. 2 is a side cross sectional view of the printer with a process cartridge removed from the printer.

The removal of the process cartridge 17 performed by a user will be described with reference to FIGS. 2 and 3. When the process cartridge 17 is removed from the printer 1 in the state shown in FIG. 1, the user first opens the front cover 49 of the printer 1 toward the front side thereof, as shown in FIG. 2. At this time, the front cover 49 pivots about a support shaft 49*z* as a pivot. The support shaft 49*z* is located above the sheet cassette 6.

With the front cover 49 open, the process cartridge 17 in the state of FIG. 1 is pulled out toward the front side of the printer 1 (removing direction) substantially in the horizontal direction. The process cartridge 17 is removed from the printer 1 while passing over the pick-up roller 8. As described above, a space is formed between the process cartridge 17 and the scanner unit 16 when the process cartridge 17 is installed in the printer 1. Therefore, the process cartridge 17 can be pulled out from the main casing 2, while the user raises a handle located on the front side of the process cartridge 17 (side near the pick-up roller 8) toward the scanner unit 16. With such a structure, the rear side of the process cartridge 17 (image forming position P side) is not likely to be caught in the printer 1. Thus, the process cartridge 17 can be smoothly pulled out from the printer 1.

Figure 3:
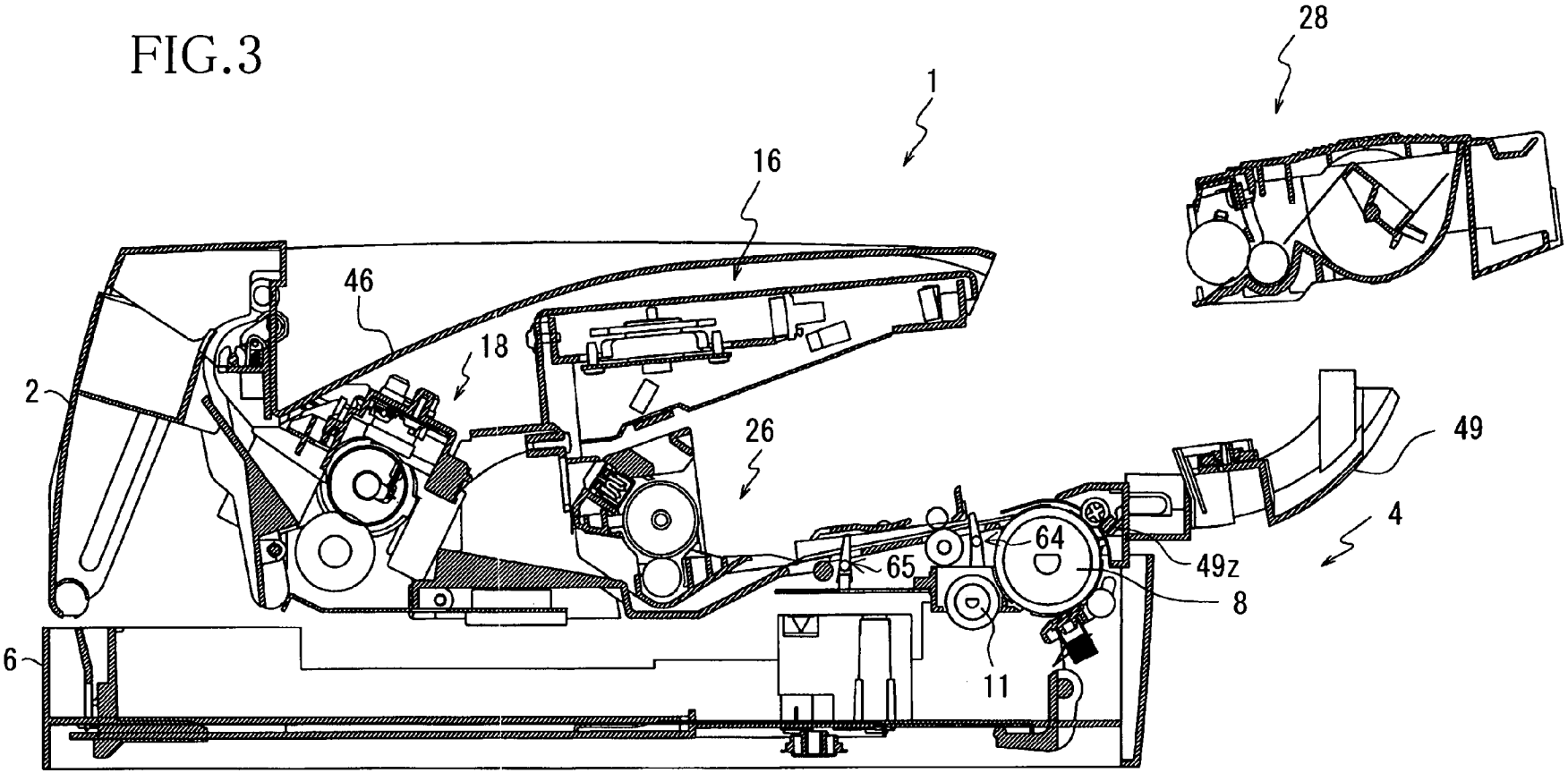
FIG. 3 is a side cross sectional view of the printer illustrating only a developing cartridge of the process cartridge removed from the printer.

As shown in FIG. 3, only the developing cartridge 28 can be detached from the printer 1, while the drum cartridge 26 of the process cartridge 17 is left inside the printer 1.

With reference to FIGS. 4A to 4D, the detector 64 will be described in detail below. As shown in FIG. 4A, the detector 64 includes a lever 66 as an example of a movement member and an optical sensor 68.

Figure 4C:
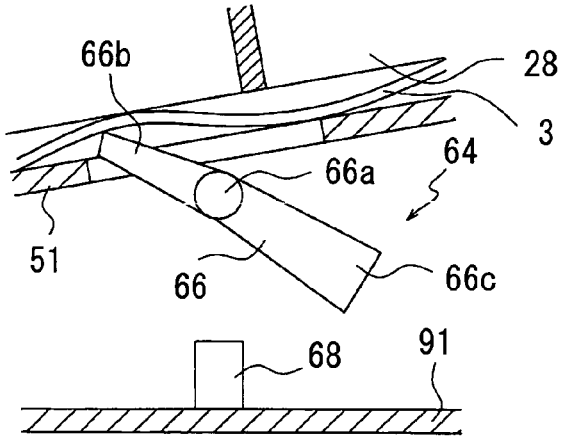
Figure 4D:
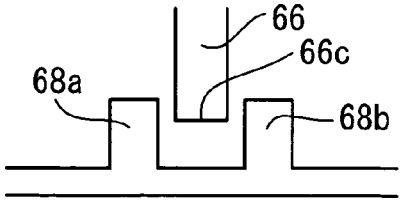

The optical sensor 68 is a conventional sensor including a light emitting element 68*a* and a light receiving element 68*b* (FIG. 4D). The optical sensor 68 is mounted on a sensor PCB 91. As the light from the light emitting element 68*a* is detected by the light receiving element 68*b*, the optical sensor 68 is on. In other words, the lever 66 is not detected by the sensor 68. When the light from the light emitting element 68*a* is not detected by the light receiving element 68*b*, due to a first end 66*c* of the lever 66 blocking an optical path from the light emitting 68*a* element to the light receiving element 68*b*, the optical sensor 68 is off. In other words, the lever 66 is detected.

The lever 66 pivots about a rotation shaft 66*a*. The lever 66 is provided such that the rotation shaft 66*a* is disposed below the guide member 51 and a second end 66*b* is disposed above the guide member 51. When the developing cartridge 28 of the process cartridge 17 is not installed in the printer 1, the lever 66 is in a position as shown in FIG. 4A (third position). More specifically, the second end 66*b* of the lever 66 is positioned upstream of the rotation shaft 66*a* in the sheet feeding direction, and the first end 66*c* of the lever 66 is in a position that is undetectable by the optical sensor 68.

When the developing cartridge 28 of the process cartridge 17 is installed in the printer 1, the second end 66*b* of the lever 66 makes contact with a part of the developing cartridge 28, so that the lever 66 is placed in a position as shown in FIG. 4B (first position). More specifically, as the developing cartridge 28 is moved in a direction shown by the arrow in FIG. 4B to install the developing cartridge 28 in the printer 1, the second end 66*b* of the lever 66 is pushed by the developing cartridge 28. Thus, the first end 66*c* of the lever 66 is moved to a position, between the light emitting element 68*a* and the light receiving element 68*b*, where the first end 66*c* is detected by the optical sensor 68. With the first end 66*c* in the position that is detectable by the optical sensor 68, the control device 70 (described below) determines that the developing cartridge 28 is installed in the printer 1 and sets the image forming portion 5 to an image formable state.

In a state shown in FIG. 4B, as the sheet 3 is fed in the sheet feed path and contacts the second end 66*b* of the lever 66, the lever 66 moves to a position as shown in FIG. 4C (second position). More specifically, the second end 66*b* of the lever 66 is pushed downstream in the sheet feeding direction, so that the first end 66*c* of the lever 66 is moved to a position undetectable by the optical sensor 68.

Figure 5A:
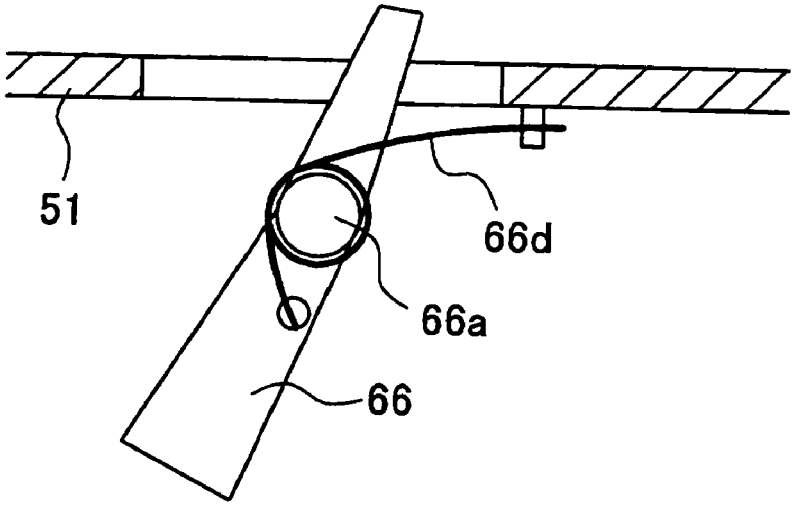
FIGS. 5A and 5B are explanatory views of a spring provided on the detector.
Figure 5B:
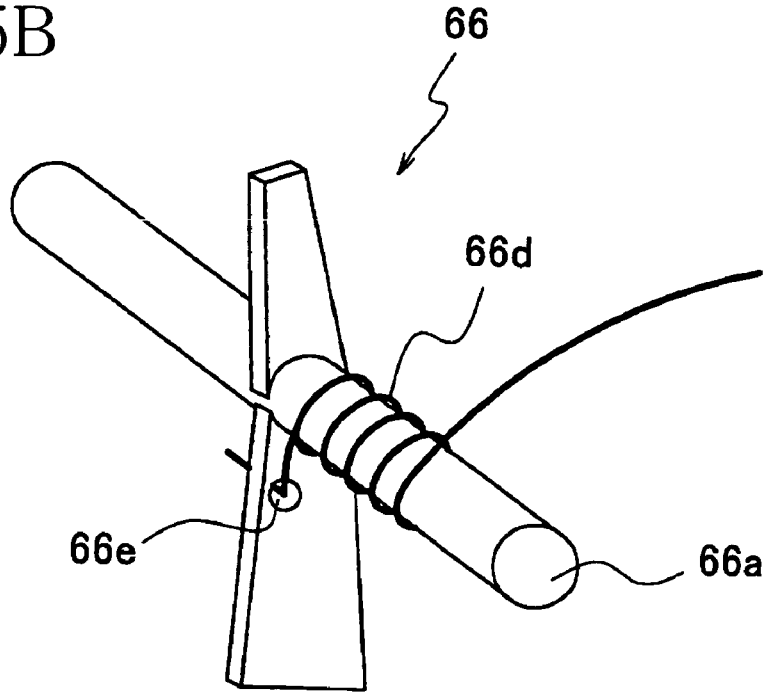

With the lever 66 in the position shown in FIG. 4A, the second end 66*b* of the lever 66 does not make contact with the developing cartridge 28, as described above. To keep the lever 66 in that position, the lever 66 is provided with a spring 66*d*, as shown in FIGS. 5A and 5B. The spring 66*d* is only illustrated in FIGS. 5A and 5B and omitted in other drawings.

The spring 66*d* winds around the rotation shaft 66*a* of the lever 66, with an end thereof inserted into a hole 66*e* formed in the lever 66 and the other end fixed on a lower side of the guide member 51. By an urging force of the spring 66*d*, the lever 66 is always urging toward its original position (position shown in FIG. 4A). Therefore, when the developing cartridge 28 is not installed in the printer 1, the lever 66 is kept in the position shown in FIG. 4A. When the developing cartridge 28 is installed in the printer 1 but the lever 66 does not contact the sheet 3, the lever 66 is placed in the position shown in FIG. 4B.

Figure 7:
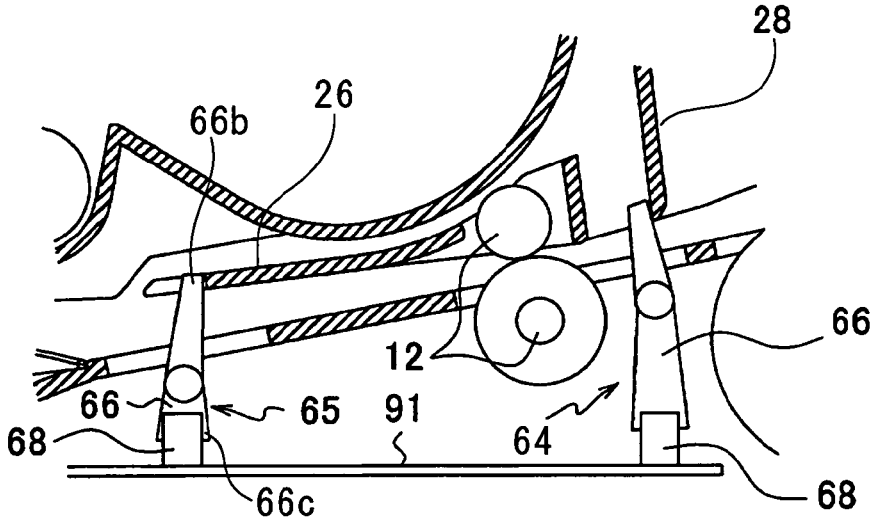
FIG. 7 is a cross sectional view showing a periphery of the detector.

A detector 65 has substantially the same structure as the detector 64, so that detailed description with respect to the detector 65 is omitted. However, the detector 65 is structured so as to detect the drum cartridge 26 and the sheet 3. When the detector 65 is not detecting the sheet 3 with the drum cartridge 26 installed in the printer 1, the second end 66*b* of the lever 66 of the detector 65 contacts the drum cartridge 26, as shown in FIG. 7. Thus, the first end 66*c* of the lever 66 is placed in a position detectable by the optical sensor 68. The spring 66*d* in the detector 65 applies to the lever 66 an urging force to place the first end 66*c* to a detectable position by the optical sensor 68 when the drum cartridge 26 is installed in the printer 1 but the lever 66 of the detector 65 does not contact the sheet 3, as shown in FIG. 7.

Figure 6:
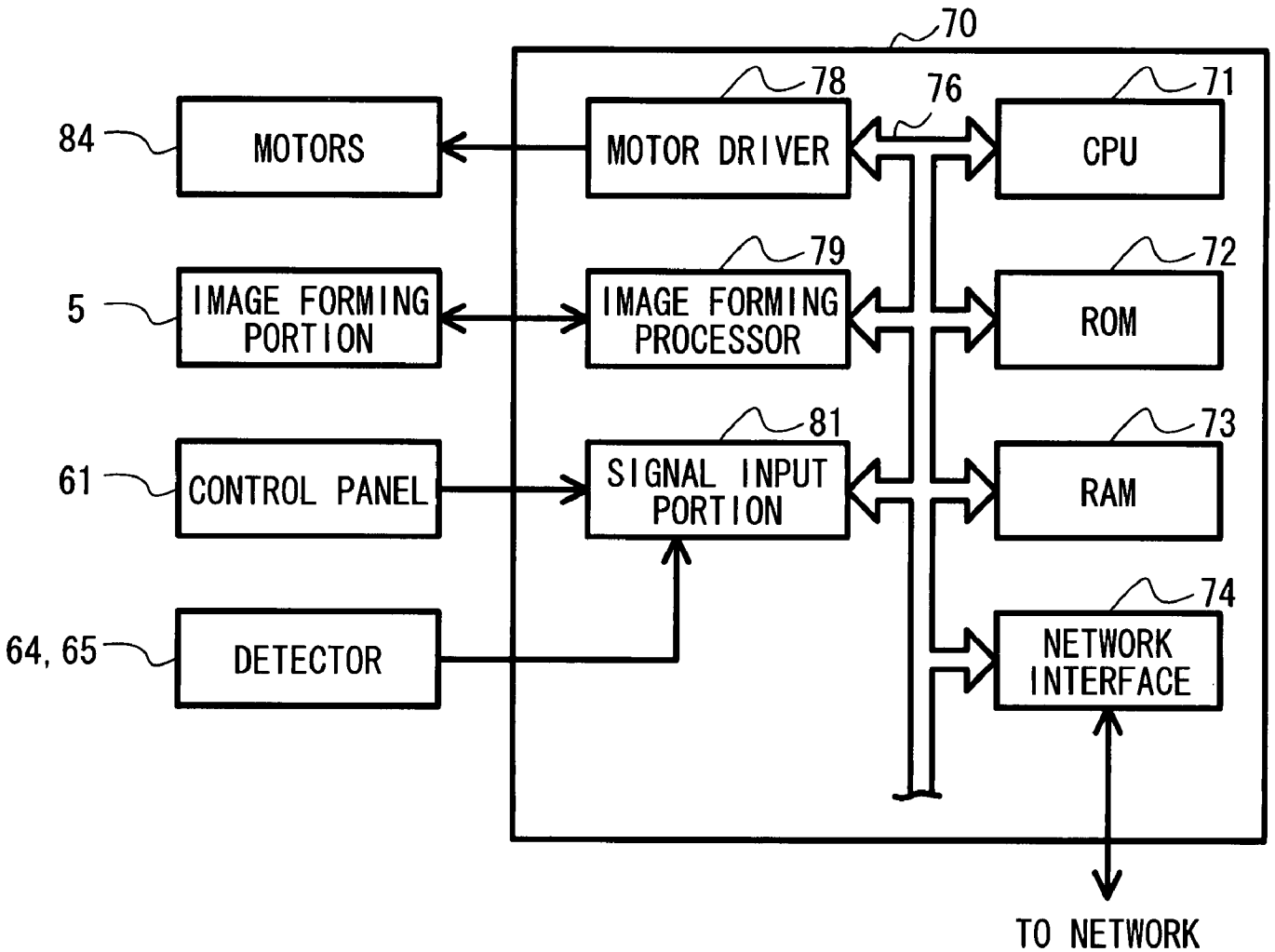
FIG. 6 is a block diagram illustrating an electrical configuration of the printer.

A control system of the printer 1 will be described in detail below, with reference to FIG. 6. The control device 70 is a conventional microcomputer including a CPU (central processing unit) 71, a ROM (read only memory) 72, a RAM (random access memory) 73, and a bus line 76 that interconnects elements of the control device 70. The control device 70 includes a motor driver 78, an image forming processor 79, a signal input portion 81, and a network interface 74.

The CPU 71 performs drive controls for the motor driver 78 and the image forming processor 79, based on programs stored in the ROM 72 and signals input from the signal input portion 81.

The motor driver 78 drives various motors 84, such as a main motor (not shown), by sending a drive pulse to the motors 84, upon the reception of a command from the CPU 71.

The main motor is used for driving various rollers provided in the scanner unit 16, the process cartridge 17, and the fixing unit 18, to feed the sheet 3.

The image forming processor 79 controls the image forming portion 5, based on a command from the CPU 71. More specifically, the image forming processor 79 performs controls for exposing the surface of the photosensitive drum 27 to light using components of the scanner unit 16 and for applying a transfer bias when the toner is transferred from the photosensitive drum 27 to the sheet 3.

Each of the detectors 64, 65 detects the sheet 3 at a respective detecting position. The detection result is sent to the signal input portion 81. At this time, the CPU 71 displays an error message of "paper jam" in an indicator (not shown), when the sheet 3 is not in the position where the sheet 3 is supposed to be, or is in the position where the sheet 3 is not supposed to be, by associating the drive pulses sent from the motor driver 78 to the motors 84 with the detection made by the detectors 64, 65,.

The CPU 71 of the control device 70 performs control for correcting the skew of the sheet 3, based on the result of the detection by the detector 64. More specifically, the control device 70 drives the register rollers 12 when the sheet 3 is fed by the pick-up roller 8. As the detector 64 detects the leading edge of the sheet 3, the control device 70 stops the register rollers 12. As the sheet 3 makes contact with the register rollers 12 and becomes slack, the control device 70 drives the register rollers 12 again, to feed the sheet 3 to the image forming portion 5. The detector 64 also detects the leading edge of the sheet 3 fed through the manual feed slot 14. The CPU 71 of the control device 70 performs the control for correcting the skew of the sheet 3, as described above, based on the result of the detection by the detector 64.

The CPU 71 of the control device 70 performs control for the exposure timing of irradiating the photosensitive drum 27 with the laser beam, based on the timing of the detection of the sheet 3 by the detector 65. More specifically, the control device 70 feeds the sheet 3 by a predetermined distance (or for a predetermined time) after the sheet 3 is detected by the detector 65. Then, the control device 70 starts to irradiate the photosensitive drum 27 with the laser beam.

The CPU 71 performs the drive controls for the units of the printer 1, to form an image based on image data input through the network interface 74 on the sheet 3.

The printer 1 includes the process cartridge 17 and the sheet feed path for feeding the sheet 3 supplied from the sheet cassette 6 accommodating the sheets 3 therein and from a position outside the printer 1, through the image forming position P. The process cartridge 17 is disposed near a part of the sheet feed path, so as to be removable from the printer 1. The detector 64 is disposed on the sheet feed path. When the process cartridge 17 is installed in the printer 1, the detector 64 detects the installation of the developing cartridge 28 as the detection condition of the detector 64 changes with the movement of the lever 66. As the detection condition of the detector 64 is changed while the detector 64 is detecting the installation of the developing cartridge 28, it is determined that the sheet 3 passes over the detector 64.

In order to distinguish between the state shown in FIG. 4A and the state shown in FIG. 4C, the CPU 71 receives a signal from another existing detector. For example, a signal from a detector that detects whether the front cover 49 is open can be used. The CPU 71 determines that the developing cartridge 28 is absent when it is detected that the front cover 49 is open and the lever 66 is in a position that is undetectable by the optical sensor 68. Conversely, the CPU 71 determines the presence of the sheet 3 when it is detected that the front cover 49 is closed and the lever 66 is in a position that is undetectable by the optical sensor 68.

The detector 64 disposed on the sheet feed path includes the lever 66 that moves to a predetermined position when the developing cartridge 28 of the process cartridge 17 is installed in the printer 1, and moves to another position when the lever 66 makes contact with the sheet 3 fed along the sheet feed path. The detector 64 also includes the optical sensor 68 that detects the positional changes of the lever 66.

With the printer 1 structured as described above, a detector for detecting the process cartridge 17, which is removable from the printer 1, does not have to be provided separately from the detector 64 which is used for detecting the sheet 3. Thus, a detector for detecting the installation of the process cartridge 17 does not have to be additionally provided as the detector 64 can be effectively used. Accordingly, the downsizing of the printer 1 can be achieved.

Further, the optical sensor 68 includes the light emitting element 68*a* and the light receiving element 68*b*. The lever 66, which mechanically moves, blocks or unblocks an optical path between the light emitting element 68*a* and the light receiving element 68*b*. Thus, the positional changes of the lever 66 can be detected.

The printer 1 uses the optical sensor 68 and detects an ON and an OFF of the sensor 68. Thus, structures of the printer 1 can be simplified and, in turn, production costs of the printer 1 can be reduced.

The optical sensor 68 detects the mechanical movement of the lever 66. Therefore, detection can be reliably made even when the sheet 3 or the process cartridge 17 is contaminated. Further, when the lever 66 of the detector 64 is not making contact with the developing cartridge 28 of the process cartridge 17 or the sheet 3, the lever 66 is in the third position. When the lever 66 of the detector 64 contacts the sheet 3, the lever 66 is moved to the second position. When the lever 66 is not making contact with the sheet 3 but is making contact with the developing cartridge 28, the lever 66 is in the first position between the third position and second position. Only when the lever 66 of the detector 64 is in the first position, the detector 64 blocks the optical path of the optical sensor 68.

The printer 1 can achieve a simple structure that detects the positional changes of the lever 66 of the detector 64 relative to the optical sensor 68.

Further, the printer 1 is provided with the spring 66*d*, as an urging member, that urges the lever 66 to place the lever 66 in the third position when the lever 66 is not making contact with the developing cartridge 28 or the sheet 3. With the urging force of the spring 66*d*, the lever 66 tends to be in the third position when the lever 66 is not making contact with the developing cartridge 28 or the sheet 3. Therefore, a false detection by the optical sensor 68 from the lever 66 that may be moved, for example, when vibrations are applied, can be prevented.

The process cartridge 17 has the drum cartridge 26 including at least the photosensitive drum 27 and the developing cartridge 28 including at least the toner box 34. The developing cartridge 28 is positioned by the drum cartridge 26. The process cartridge 17 is structured such that only the developing cartridge 28 can be removed from the printer 1, without removing the drum cartridge 26 from the printer 1. Further, the lever 66 of the detector 64 is movable as the developing cartridge 28 is installed in the printer 1 and contacts the lever 66.

In the thus-structured printer 1, as the developing cartridge 28 is detected with the optical sensor 68 of the detector 64 detecting the lever 66, it also can be determined that the drum cartridge 26 is installed in the printer 1. Thus, only by detecting the developing cartridge 28, it can be detected that the drum cartridge 26 is installed in the printer 1.

The detector 65 disposed on the sheet feed path includes the lever 66 that moves when the drum cartridge 26 is installed in the printer 1, and moves to another position when the lever 66 makes contact with the sheet 3 fed along the sheet feed path. The detector 65 also includes the optical sensor 68 that detects the positional changes of the lever 66 of the detector 65.

With such a structure, detection as to whether the drum cartridge 26 is installed in the printer 1, can be reliably made. Further, the levers 66 of the detector 64 and the detector 65 are disposed between the sheet cassette 6 and the image forming position P, such that the sheet 3 contacts the lever 66 of the detector 64 first and then the lever 66 of the detector 65 in the sheet feed path. The control device 70 performs the control for driving the register rollers 12, which are disposed downstream of the lever 66 of the detector 64 in the sheet feeding direction, based on the timing when the optical sensor 68 of the detector 64 detects the sheet 3, with the positional changes of the lever 66 of the detector 64. Thus, the skew of the sheet 3, which is fed in the sheet feed path, is corrected. Further, the control device 70 controls the timing when the electrostatic latent image is formed on the photosensitive drum 27, based on the timing when the optical sensor 68 of the detector 65 detects the sheet 3 with the positional changes of the lever 66 of the detector 65.

In the printer 1, the optical sensor 68 of each detector 64, 65 detects the movement of the relevant lever 66. Based on the detection result, the printer 1 performs the controls for the timing of the formation of the electrostatic latent image on the photosensitive drum 27, as well as for the correction of the sheet skew. Thus, an image is preferably formed on the sheet 3.

The process cartridge 17 is installed in the printer 1 in the substantially same direction as the sheet feeding direction at the image forming position P. At least one second end 66*b* of at least one lever 66 of the detectors 64, 65 is moved downstream in the sheet feeding direction when the process cartridge 17 is installed in the printer 1. In this state, as the sheet 3 contacts the lever 66, the second end 66*b* of the lever 66 is further moved downstream in the sheet feeding direction.

In the printer 1, the lever 66 can be structured with a simple structure to move only in one direction. Thus, each optical sensor 68 of the detectors 64, 65 can reliably detect the developing cartridge 28 and the drum cartridge 26, respectively, as well as the sheet 3.

The sheet feed path is formed into a substantially "S" shape when viewed from an axial direction of the photosensitive drum 27. Thus, a relatively long sheet feed path is formed in the printer 1 and components of the printer 1 can be effectively disposed in position near the sheet feed path.

An outer surface of the process cartridge 17 (mainly a lower surface of the drum cartridge 26) is used as a part of a wall defining the sheet feed path. Therefore, the wall that separates the sheet feed path and the process cartridge 17 is not required in the printer 1. Thus, the printer 1 can be downsized.

While the embodiment of the disclosure is described in detail, those skilled in the art will recognize that there are many possible modifications and variations which may be made in the embodiment.

For example, in the above-described embodiment, the detectors 64, 65 are structured to detect the sheet 3. The detector 64 disposed upstream of the register rollers 12 in the sheet feed path is structured to detect whether the developing cartridge 28 is installed in the printer 1. However, the structures of the detectors 64, 65 are not limited to those described in the above embodiment.

Figure 8A:
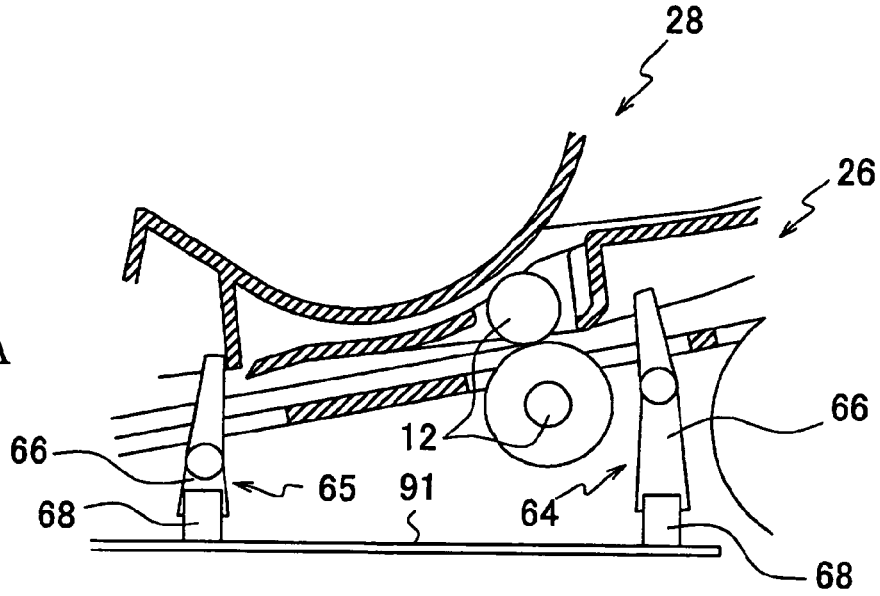
FIGS. 8A and 8B are cross sectional views showing a periphery of the detector according to a modification of the first embodiment.

More specifically, the detector 65 disposed downstream of the register rollers 12 in the sheet feed path may detect whether the developing cartridge 28 is installed in the printer 1, as shown in FIG. 8A.

Figure 8B:
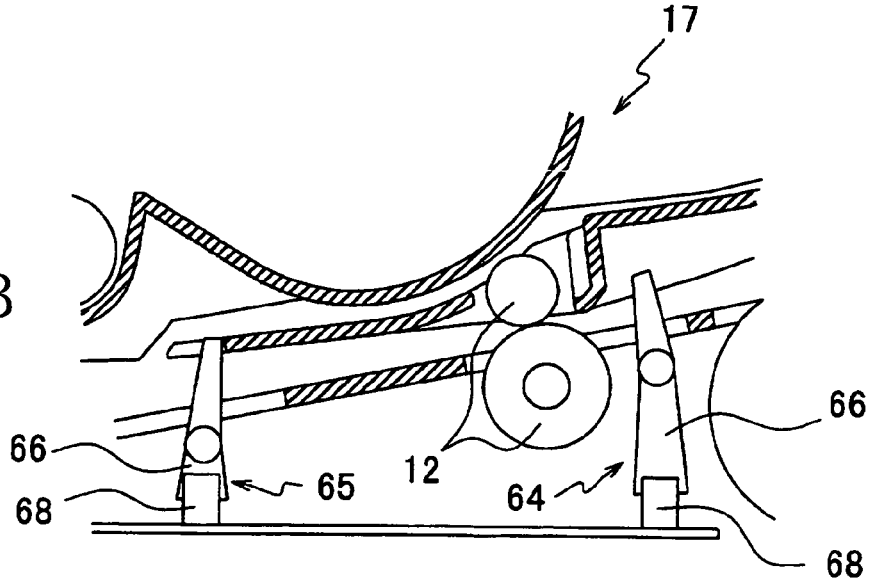

The process cartridge 17 may be formed as one inseparable or integral unit, or may be separable only after the process cartridge 17 is removed from the printer 1. In these cases, at least one detector 64, 65 may be used to detect the process cartridge 17. For example, the lever 66 of the detector 65 may be structured to contact the process cartridge 17, as shown in FIG. 8B. Thus, the process cartridge 17 may be detected.

The control device 70 of the printer 1 performs the control for providing the exposure timing when the electrostatic latent image is formed on the photosensitive drum 27, based on the detection of the detector 65 disposed downstream of the register rollers 12 in the sheet feeding direction. However, the control device 70 of the printer 1 may perform the control for providing the exposure timing, based on the detection of the detector 64 disposed upstream of the register rollers 12.

In the detector 64, the movement of the lever 66 is detected by the optical sensor 68. However, other structures may be employed. For example, the process cartridge 17 may be provided with a reflecting mirror, and the main casing 2 of the printer 1 may be provided with an optical sensor including a light emitting element 68*a* and a light receiving element 68*b*. With such structures, the process cartridge 17 may be detected with the optical sensor, as light from the light emitting element 68*a* is reflected off the reflecting mirror and the reflected light is received by the light receiving element 68*b*. With the process cartridge 17 being detected by the optical sensor, the sheet 3 may be detected as the light is not received by the light receiving element 68*b*.

Used in the embodiment as a sensor for detecting the sheet 3 and the installation of the drum cartridge 26 and the developing cartridge 28 of the process cartridge 17, is the optical sensor 68 that detects whether the optical path between the light emitting element 68*a* and the light receiving element 68*b* is blocked. However, other structures may be employed. For example, a magnetic sensor may be used that can detect a precise angle or position of the lever 66.

A second embodiment will be described below. A major difference between the previous embodiment is the detectors 92, 93 disposed near the register rollers 12. Therefore, only the differences from the first embodiment will be described in detail below. It should be noted that similar reference numerals denote similar elements and a detailed description with respect to the second embodiment is omitted.

Figure 9:
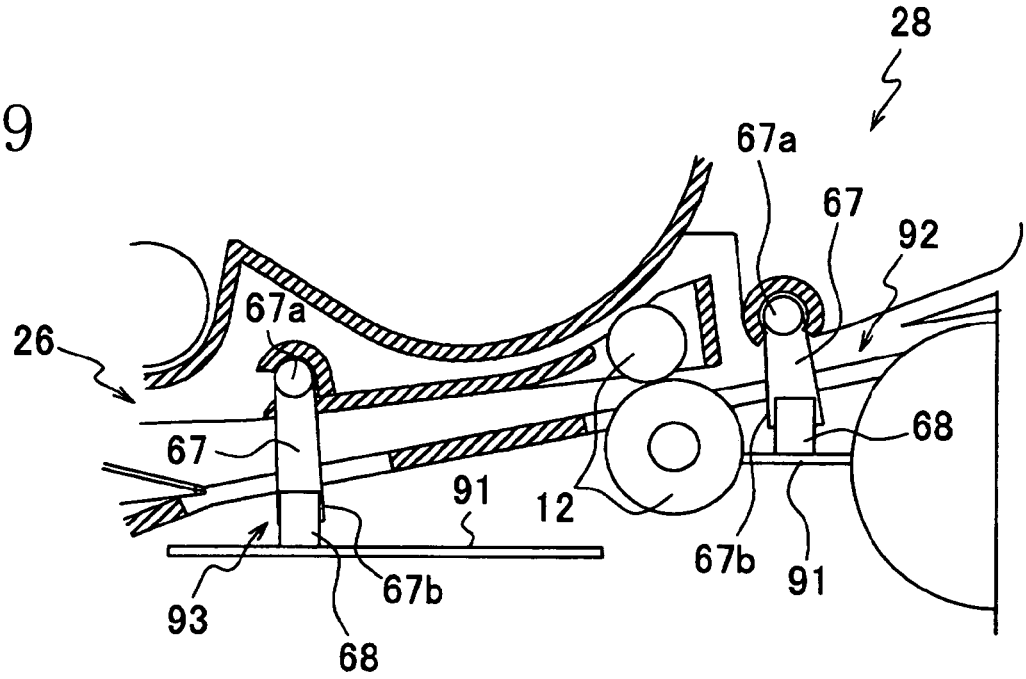
FIG. 9 is a cross sectional view showing a periphery of a detector according to a second embodiment.

With reference to FIG. 9, the detectors 92, 93 will be described in detail below.

In the printer 1, the detectors 92, 93 are disposed near positions where the detectors 64, 65 are disposed in the first embodiment. More specifically, the detector 92 is disposed upstream of the register rollers 12 in the sheet feeding direction. The detector 93 is disposed downstream of the register rollers 12 in the sheet feeding direction.

The detector 92 includes a lever 67 and the optical sensor 68, which is similar to the sensor 68 according to the first embodiment. The lever 67 pivots about a rotation shaft 67*a*. The rotation shaft 67*a* of the lever 67 of the detector 92 is fitted to a part of the developing cartridge 28.

The optical sensor 68 of the detector 92 is fixed on the sensor PCB 91, such that the lever 67 faces directly downward when the developing cartridge 28 is installed in the printer 1, and accordingly one end 67*b* of the lever 67 can be detected by the optical sensor 68.

The detector 93 is structured similar to the detector 92. However, the rotation shaft 67*a* of the lever 67 of the detector 93 is fitted to a part of the drum cartridge 26.

Figure 10A:
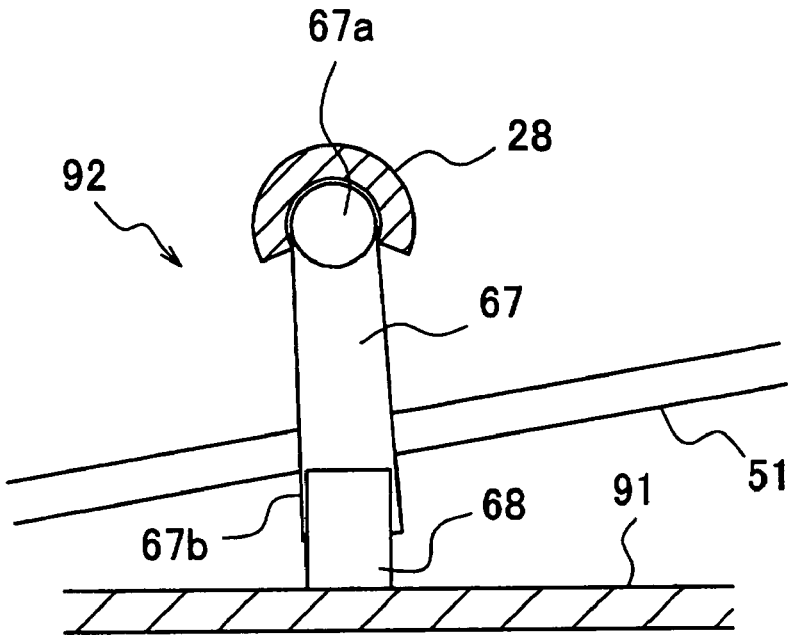
FIGS. 10A and 10B are explanatory views illustrating operations of a lever of the detector.
Figure 10B:
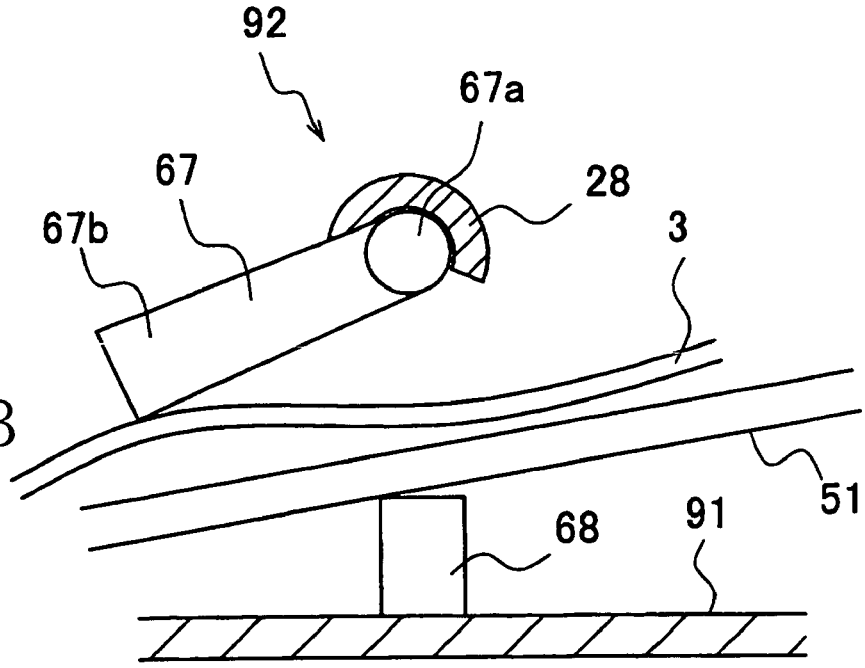

With reference to FIGS. 10A and 10B, the movement of the lever 67 of the detector 92 will be described below.

As the drum cartridge 26 and the developing cartridge 28 of the process cartridge 17 are installed in the printer 1, the lever 67 fitted in the developing cartridge 28 hangs down due to gravity and the one end 67*b* of the lever 67 is placed in a position detectable by the optical sensor 68, as shown in FIG. 10A.

In this state, as the sheet 3 is fed along the sheet feed path, the sheet 3 contacts the lever 67 and is pushed downstream in the sheet feeding direction. At this time, the one end 67*b* of the lever 67 is moved to a position away from the optical sensor 68, as shown in FIG. 10B, so that the optical sensor 68 cannot detect the one end 67*b* of the lever 67.

The movement of the lever 67 of the detector 93 is similar to the that of the lever 67 of the detector 92, so that detailed description with respect to the movement of the of the lever 67 of the detector 93 is omitted. However, the lever 67 of the detector 93 faces directly downward when the drum cartridge 26 is placed in position in the printer 1, such that the one end 67*b* of the lever 67 is detectable by the optical sensor 68.

In the second embodiment, the optical sensor 68 is disposed on the main casing 2 of the printer 1. The lever 67 is disposed on the process cartridge 17, which is removable relative to the printer 1. When the process cartridge 17 is installed in the printer 1, the lever 67 is positioned such that the lever 67 is detectable by the optical sensor 68 with the rotation shaft 67*a* above the guide member 51 and the one end 67*b* below the guide member 51. In this state, as the lever 67 contacts the sheet 3 fed in the sheet feed path, the lever 67 is moved to a position undetected by the optical sensor 68.

In the printer 1 according to the second embodiment installing therein the process cartridge 17, the lever 67 detects the sheet 3, as well as installation of the process cartridge 17, in cooperation with the optical sensor 68 provided in the printer 1. By effectively using the optical sensor 68, installation of the process cartridge 17, which is removable from the printer 1, can be detected. Such structures may achieve the reduction of the printer size.

When the levers 67 of the detectors 92, 93 are not making contact with the sheet 3, the levers 67 are hung down due to gravity. However, other structures may be used. For example, the lever 67 may be urged by a spring so as to face directly downward, as the lever 66 according to the first embodiment is urged by the spring 66*d*. With such a structure, even when external force, such as vibration, is applied to the printer 1, the lever 67 does not tend to move so that errors in the detection by the detectors 92, 93 can be prevented.

The drum cartridge 26 and the developing cartridge 28 of the process cartridge 17 are separable. However, the drum cartridge 26 and the developing cartridge 28 may be integrally formed as the process cartridge 17, such that the drum cartridge 26 and the developing cartridge 28 cannot be separated at the time of the installation/removal of the process cartridge 17 in/from the printer 1.

Figure 11:
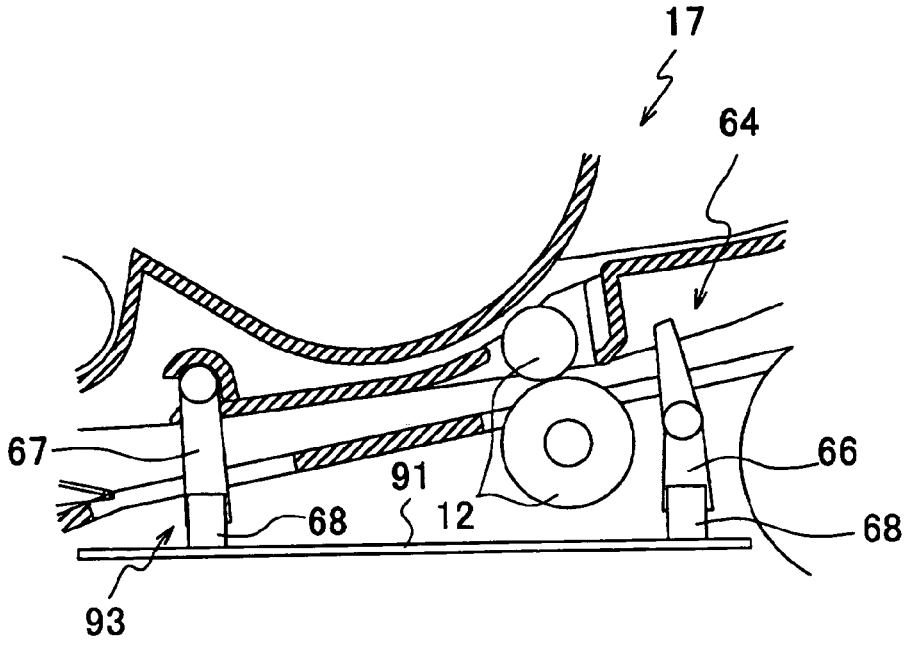
FIG. 11 is a cross sectional view showing the periphery of the detector according to a modification of the second embodiment.

In this case, as shown in FIG. 11, for the detector disposed upstream of the register rollers 12 in the sheet feeding direction, the detector 64 according to the first embodiment may be employed. For the detector disposed downstream of the register rollers 12 in the sheet feeding direction, the detector 93 according to the second embodiment may be employed.

While this disclosure has been described in conjunction with the exemplary embodiments outlined above, various alternatives, modifications, variations, improvements and/or substantial equivalents, whether known or that are or may be presently unforeseen, may become apparent to those having at least ordinary skill in the art. Accordingly, the exemplary embodiments of the disclosure, as set forth above, are intended to be illustrative, not limiting. Various changes may be made without departing from the spirit and scope of the disclosure. Therefore, the disclosure is intended to embrace all known or later developed alternatives, modifications, variations, improvements and/or substantial equivalents.

What is claimed is:

1. An image forming apparatus, comprising:

a recording medium accommodating portion that is capable of accommodating a recording medium;

a feed path along which the recording medium is capable of being fed from the recording medium accommodating portion; and a detector, disposed on the feed path, capable of detecting (1) a cartridge that is capable of being installed in the image forming apparatus when the cartridge is installed in the image forming apparatus and (2) the recording medium when the recording medium passes through the feed path when the cartridge is installed in the image forming apparatus, wherein a first movement member, disposed on the feed path, that is capable of moving to a first position when the cartridge is installed in the image forming apparatus and is capable of moving to a second position different from the first position when the recording medium passes through the feed path;

a first sensor that detects the first movement member at one of the first position or the second position;

the cartridge, that is capable of being installed in the image forming apparatus, includes a first cartridge having at least a photosensitive member and a second cartridge having at least a developer accommodating portion that is capable of accommodating a developer, the second cartridge being positioned by the first cartridge; and the first movement member contacts the second cartridge when the second cartridge is installed in the image forming apparatus.

2. The image forming apparatus according to claim 1, wherein the first sensor is an optical sensor that includes a light emitting element and a light receiving element, and the optical sensor detects whether an optical path between the light emitting element and the light receiving element is blocked by the first movement member.

3. The image forming apparatus according to claim 2, wherein:

the first movement member is at a third position when the first movement member does not contact the cartridge or the recording medium, the first movement member is at the second position when the first movement member contacts the recording medium, and the first movement member is at the first position when the first movement member contacts the cartridge but not the recording medium, the first position being disposed between the third position and the second position, and the first movement member blocks the optical path when the first movement member is at the first position.

4. The image forming apparatus according to claim 3, further comprising an urging member that urges the first movement member in the third position when the first movement member does not contact the cartridge or the recording medium.

5. The image forming apparatus according to claim 1, wherein the second cartridge is capable of being removed without removing the first cartridge from the image forming apparatus.

6. The image forming apparatus according to claim 1, further comprising:

a second movement member, disposed on the feed path, that moves to a fourth position when the first cartridge is installed in the image forming apparatus and moves to a fifth position when the recording medium passes through the feed path; and a second sensor that detects the second movement member at one of the fourth position or the fifth position.

7. The image forming apparatus according to claim 6, wherein:

the first movement member and the second movement member are disposed between the recording medium accommodating portion and an image forming position such that the recording medium first contacts the first movement member and then contacts the second movement member, and the image forming apparatus further includes a skew correction device that corrects skew of the recording medium fed on the feed path by controlling a driving of a register roller disposed downstream of the first movement member in a feeding direction of the recording medium based on a timing when the first sensor detects the recording medium.

8. The image forming apparatus according to claim 6, further comprising:

a cartridge installation portion in a main casing, wherein the cartridge is capable of being installed in the cartridge installation portion in a feeding direction along which the feed path extends, wherein:

an end of at least one of the first movement member and the second movement member moves downstream in a feeding direction of the recording medium when the cartridge is installed in the image forming apparatus and moves further downstream in the feeding direction when the recording medium contacts the at least one of the first movement member and the second movement member.

9. The image forming apparatus according to claim 1, wherein the feed path is formed into a substantially "S" shape when viewed from an axial direction of the photosensitive member.

10. The image forming apparatus according to claim 6, wherein:

the first movement member is disposed between the recording medium accommodating portion and an image forming position on the feed path, and the image forming apparatus further includes a controller that controls a timing of forming an electrostatic latent image on a photosensitive member based on a timing when the second sensor detects the recording medium.

11. The image forming apparatus according to claim 1, wherein an outer surface of the cartridge that is capable of being installed in the image forming apparatus defines at least a part of the feed path when the cartridge is installed in the image forming apparatus.

12. A cartridge, comprising:

a developer accommodating portion that is capable of accommodating a developer; and a first movement member, located outside the developer accommodating portion, that is capable of moving to a first position when the cartridge is mounted in an image forming apparatus and is capable of moving to a second position that is different from the first position when the cartridge is mounted in the image forming apparatus and a recording medium contacts the first movement member.

13. The cartridge according to claim 12, wherein the first movement member includes a shaft and a lever that pivots about the shaft.

14. The cartridge according to claim 12, wherein a first sensor of the image forming apparatus is capable of detecting the first movement member at one of the first position or the second position when the cartridge is mounted in the image forming apparatus.

15. The cartridge according to claim 14, wherein the first sensor is an optical sensor that includes a light emitting element and a light receiving element, and the first movement member is capable of blocking an optical path between the light emitting element and the light receiving element.

16. The cartridge according to claim 15, wherein:

the first movement member is at the second position when the first movement member contacts the recording medium, and the first movement member is at the first position when the first movement member does not contact the recording medium, and the first movement member blocks the optical path when the first movement member is at the first position.

17. The cartridge according to claim 12, wherein:

the cartridge includes a first cartridge having at least a photosensitive member and a second cartridge having at least the developer accommodating portion that is capable of accommodating the developer, the second cartridge being positioned by the first cartridge, the second cartridge is capable of being removed from the first cartridge, and the first movement member is mounted to the second cartridge.

18. The cartridge according to claim 17, further comprising:

a second movement member, located outside the photosensitive member, that is capable of moving to a third position when the cartridge is mounted in the image forming apparatus and is capable of moving to a fourth position that is different from the third position when the cartridge is mounted in the image forming apparatus and the recording medium contacts the first movement member.

19. The cartridge according to claim 18, wherein the first movement member and the second movement member are capable of being disposed between a recording medium accommodating portion and an image forming position such that the recording medium first contacts the first movement member and then contacts the second movement member when the cartridge is mounted in the image forming apparatus.

20. The cartridge according to claim 18, wherein an end of at least one of the first movement member and the second movement member moves downstream in a feeding direction of the recording medium when the recording medium contacts the at least one of the first movement member and the second movement member.

21. The cartridge according to claim 12, wherein the first movement member is capable of being disposed between a recording medium accommodating portion and an image forming position when the cartridge is mounted in the image forming apparatus.

22. The cartridge according to claim 12, wherein an outer surface of the cartridge is capable of defining at least a part of a feed path when the cartridge is installed in the image forming apparatus.

* * * * *